United States Patent [19]

Nelson

[11] Patent Number: 4,922,684

[45] Date of Patent: May 8, 1990

[54] CAPS FOR MILK BOTTLES AND AN APPLICATOR FOR PLACING CAPS ON BOTTLES

[75] Inventor: Laurence A. Nelson, Knoxville, Tenn.

[73] Assignee: PI, Inc., Athens, Tenn.

[21] Appl. No.: 144,564

[22] Filed: Jan. 15, 1988

[51] Int. Cl.[5] ..... B67B 3/20; B65B 7/28

[52] U.S. Cl. ..... 53/314; 53/318; 53/331.5

[58] Field of Search ..... 53/313, 314, 315, 317, 53/318, 331.5

[56] References Cited

U.S. PATENT DOCUMENTS

| | | | |
|---|---|---|---|
| 1,664,514 | 4/1928 | Kramer . | |
| 2,435,127 | 1/1948 | Cameron | 53/314 |
| 2,658,654 | 11/1953 | Schweizer | 226/88 |
| 2,680,551 | 6/1954 | Brodsky | 226/88 |
| 2,732,991 | 1/1956 | De Bastos et al. | 53/314 |
| 2,734,672 | 2/1956 | Day et al. | 226/88 |
| 2,876,605 | 3/1959 | McElroy et al. | 53/315 |
| 3,012,388 | 12/1961 | Stover | 53/315 |
| 3,071,909 | 1/1963 | Elleman | 53/315 |
| 3,274,748 | 9/1966 | Roberts et al. | 53/315 |
| 3,280,534 | 10/1966 | Hildebrandt et al. | 53/315 |
| 3,365,856 | 1/1968 | Harmon . | |
| 3,477,202 | 11/1969 | Zetterberg | 53/315 |
| 3,800,501 | 4/1974 | Raatz et al. | 53/315 |
| 3,908,341 | 9/1975 | Conti | 53/314 |
| 3,977,161 | 8/1976 | Faber et al. | 53/313 |
| 4,279,114 | 7/1981 | Bode | 53/314 |

*Primary Examiner*—Horace M. Culver

*Attorney, Agent, or Firm*—Eugene F. Friedman

[57] ABSTRACT

Caps for milk or juice bottles having four screw threads with serrations. The matching threads on the containers also display serrations. The serrations on the caps and the bottles engage each other to prevent their relative rotation to prevent the opening of the closure. An applicator places the cap onto the bottles by first twisting the caps in the reverse direction to properly seat them on the bottle necks. It then reverses the direction to start the closure. The applicator first holds the cap at an angle relative to the horizon and the direction in which the bottles move on a conveyor. As a bottle moves on the conveyor, it engages the lower, tilted edge of the cap. The bottle moving on the conveyor and in contact with the cap overcomes the tension, created by gravity, holding the cap from its location where it awaited the arrival of a bottle. An extended skirt holds the cap at a height to keep the ratchet ring on the bottom of the cap at a height above the matching ratchets on the bottle to prevent their accidental engagement.

25 Claims, 4 Drawing Sheets

FIG. 2
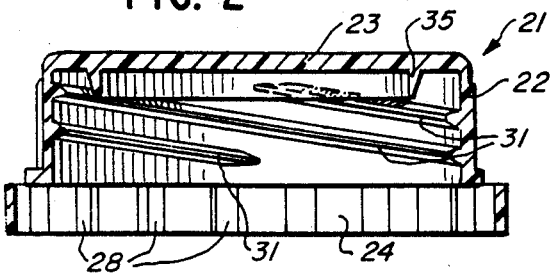
FIG. 2A
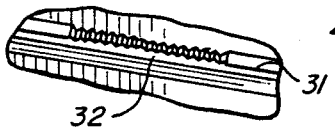
FIG. 3
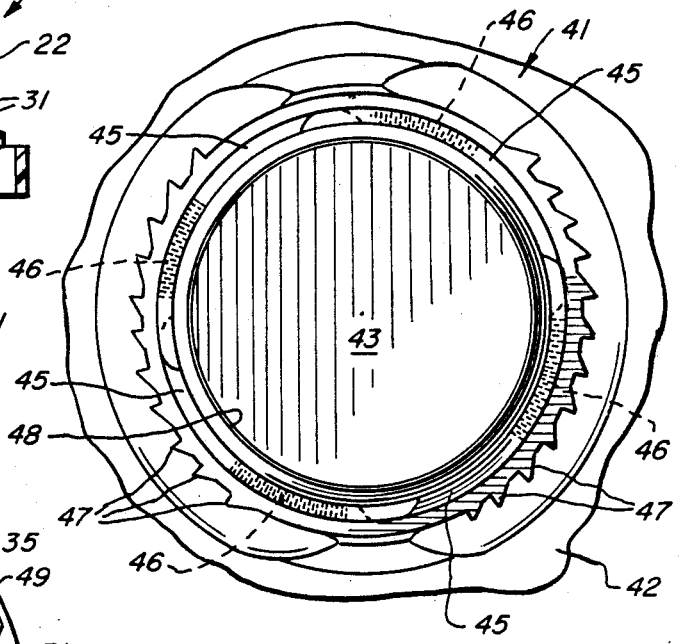
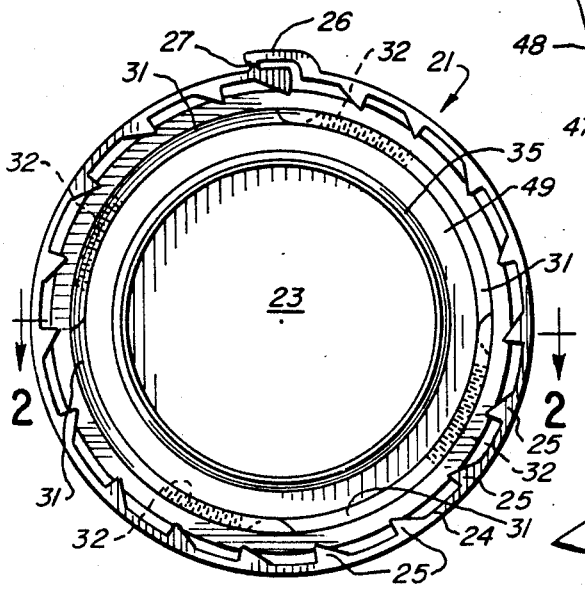
FIG. 1
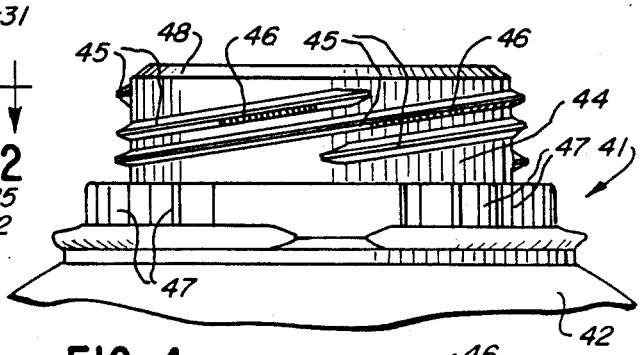
FIG. 4
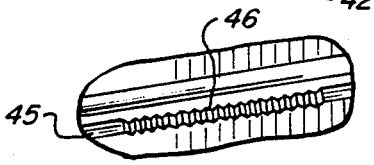
FIG. 4A
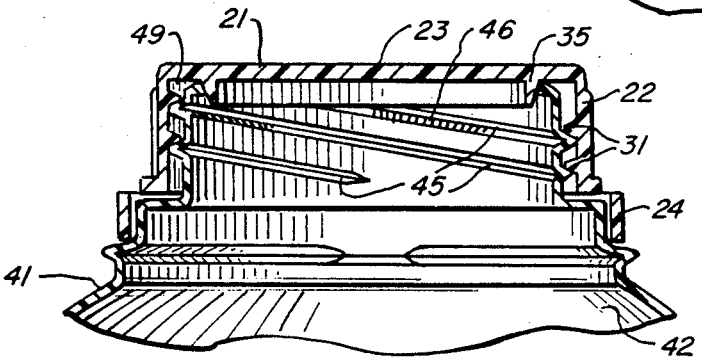
FIG. 5

FIG. 6
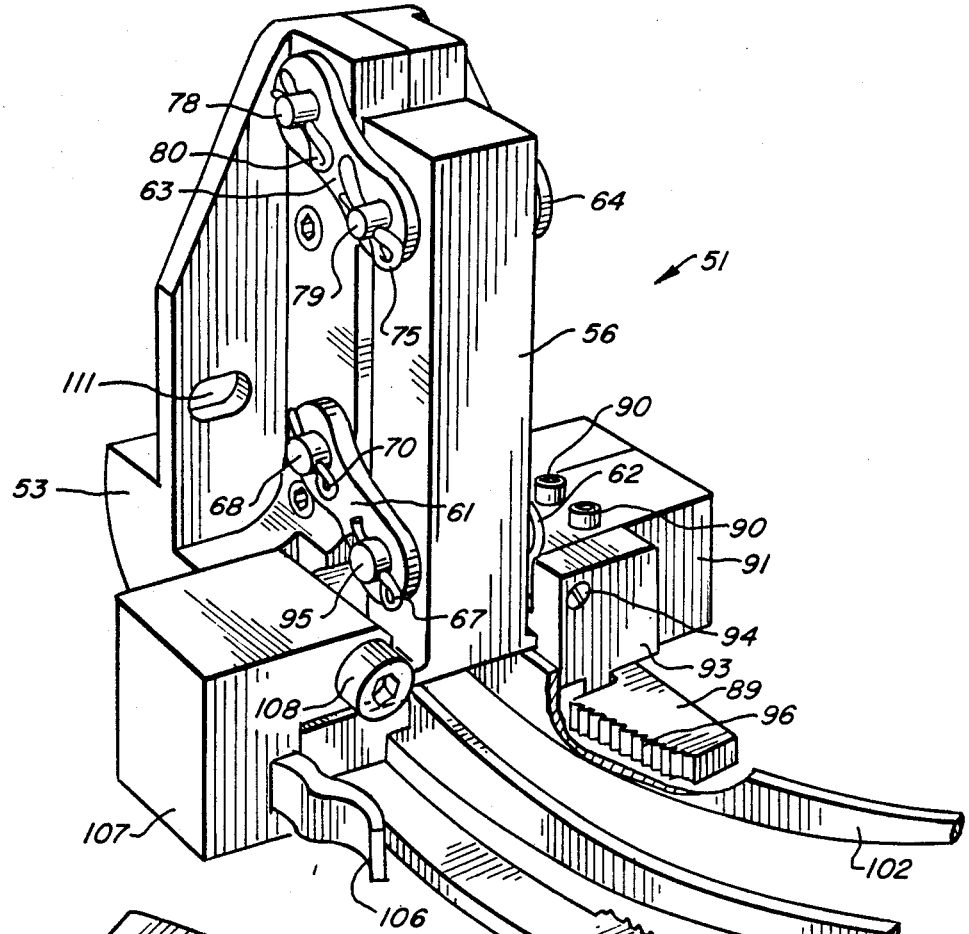
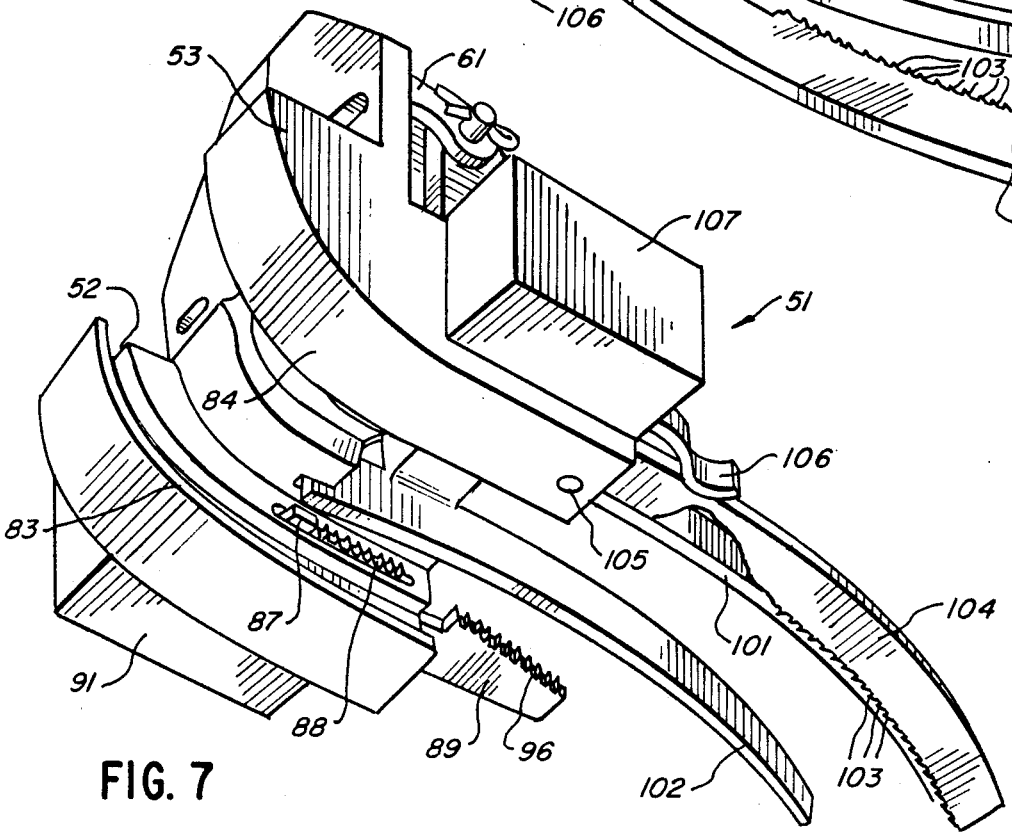
FIG. 7

FIG. 10
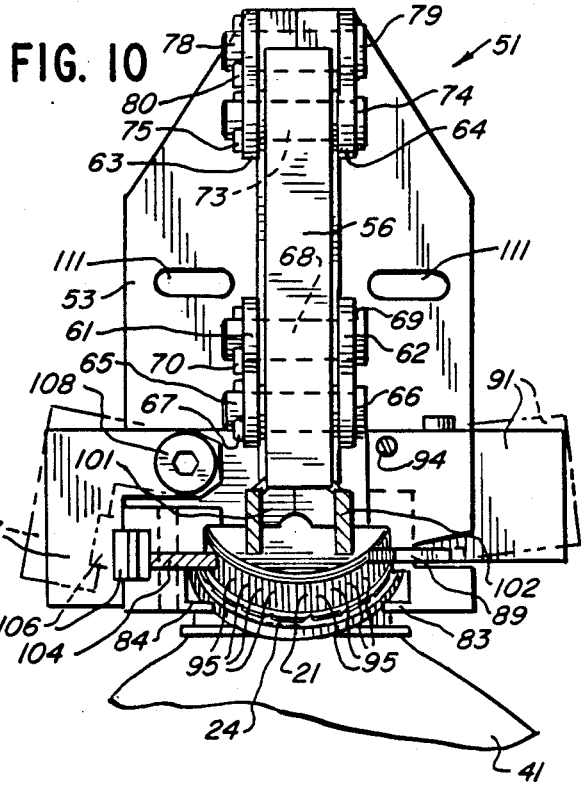
FIG. 8
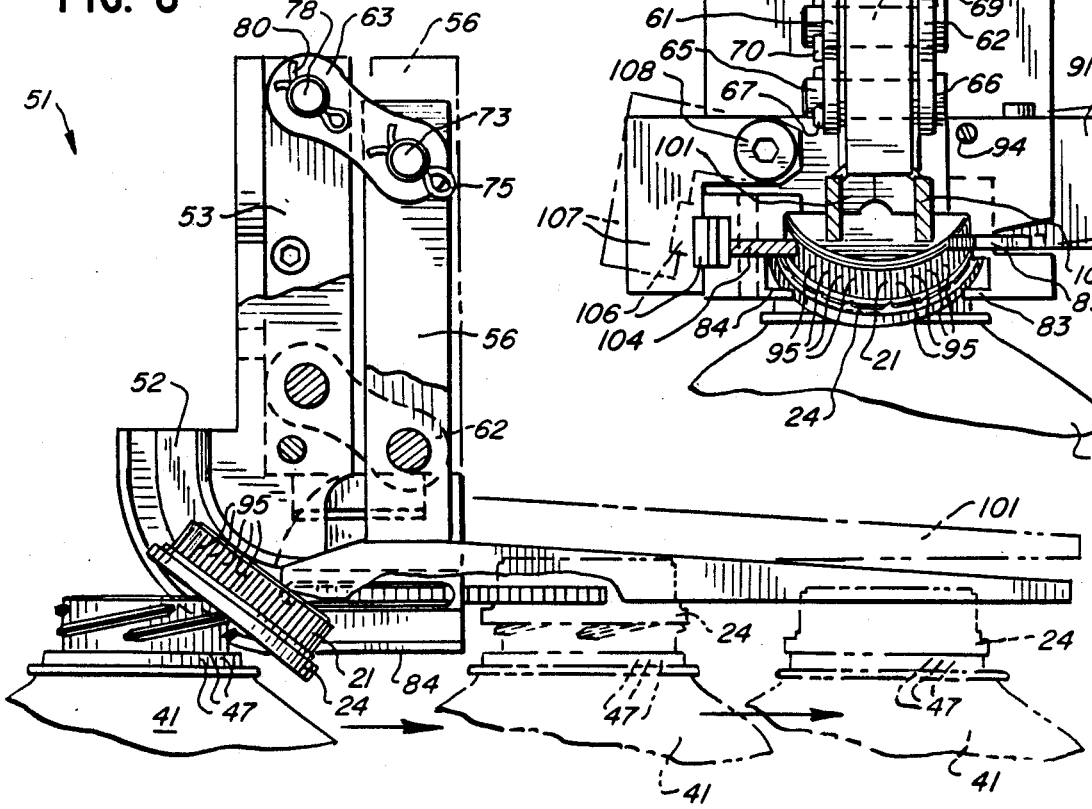
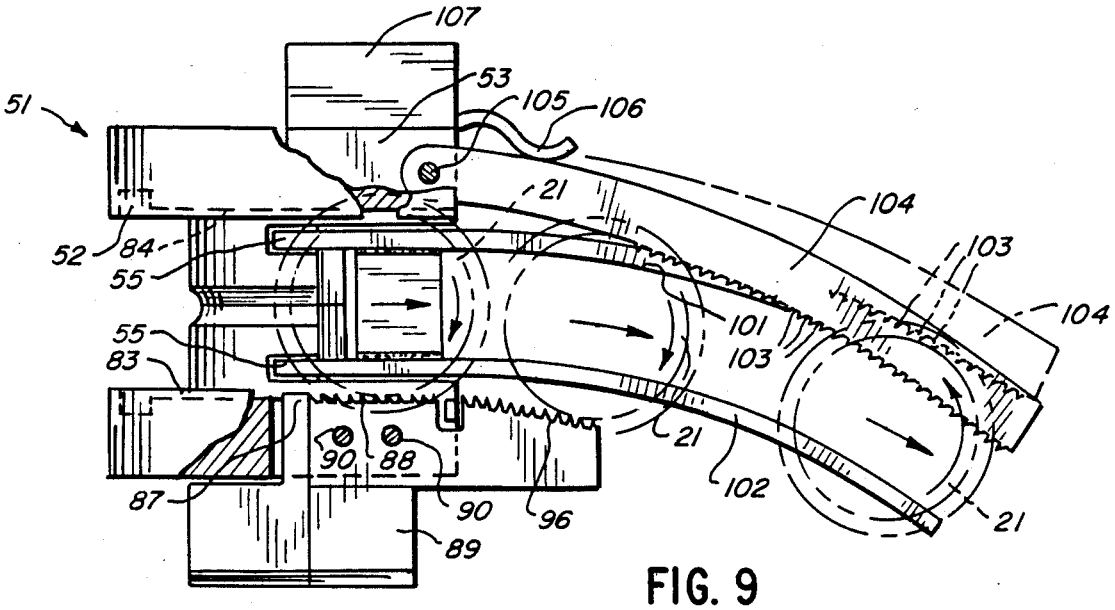
FIG. 9

CAPS FOR MILK BOTTLES AND AN APPLICATOR FOR PLACING CAPS ON BOTTLES

BACKGROUND

Milk or juice bottles, after receiving their contents of fluid, must obtain the protection of a cap screwed securely onto their openings. The placement of the closure on the container must proceed automatically on a large number of bottles moving on a conveyor. It must result in a complete and reliable closure under these automated conditions.

Plastic bottles finding use for milk and other consumable liquids have become thinner in order to reduce the amount of plastic they contain. This will lower the cost to the manufacturer and the bottler. As a consequence, the necks on the bottles have also evolved into a flexible state compared to previous bottles. Applying a cap with a single thread permits the bottle's neck to flex and thus the cap to strip across the threads.

A typical dairy or bottling plant produces many products having different lubricity. Accordingly, merely adjusting the torque of the capping equipment to keep the caps from stripping or becoming loose proves very difficult at best and impossible at worst.

Additionally, current equipment for filling and sealing milk and juice containers generally utilize an extension of the conveyor with a separate additional machine to engage the caps upon the bottles. The equipment requires additional space in the facility and substantial time to properly engage the caps.

Further, the capping equipment utilizes spring-loaded or other mechanical components to hold and twist the caps during their placement on the bottles. The tension of these components changes over time and thus alters their operating characteristics. At times, this may require the stopping of the conveyor lines to readjust the equipment to properly achieve the objectives.

Requiring greater space for the conveyor line or additional equipment increases the cost of the facility as well as the machinery required to initiate the capping process. Suspending operations of the conveyor reduces the utility of the equipment and increase the overall cost of the packaging operations. Accordingly, the search continues for a closure system and applications equipment that will reduce the cost of the operation while at the same time assuring its reliability.

SUMMARY

Utilizing a cap with four threads reduces the likelihood of stripping. To strip a cap would require the bottle's neck to flex in four separate directions at approximately the same time. The likelihood of this type of bending occurring in general decreases with the number of threads utilized by the cap and bottle neck. Four threads, in particular, would require flexing in four separate directions at once. This would prove very unlikely.

Thus, with the four-threaded cap and bottle neck, the bottler may utilize the maximum amount of torque necessary to assure that the cap will properly seat on the bottle even for the grittiest product. Nonetheless, the products having high lubricity will still not result in the flexing of the bottle neck upon the application of the cap.

Additionally, having four threads increases the helical angle of the threads themselves. As a result, the threads face each other at a greater angle relative to a twisting motion of the cap itself. This increases the difficulty of starting the stripping of the cap. Additionally, at the greater helical angle, the threads in the cap would have to cross more of the bottle's threads at very nearly the same time. This too increases the difficulty of stripping the cap from the bottle neck.

Further, providing a cap with four screw threads having a steeper helical angle allows the cap's application to a bottle with fewer turns while still providing the security of attachment. The reduced motion makes it feasible to attach the cap on a bottle moving on an established assembly line rather than adding an additional length to the line itself.

To accomplish this, typically the cap will take the form of a cylinder having a length and a diameter and a closed end. For typical milk or juice caps, the length-to-diameter ratio remains less than about one half.

Including a plurality of at least four screw threads on the interior of the cylindrical cap facilitates the application of the cap to the bottle. Minimal motion suffices to place the cap on the bottle; however, the additional threads provide the necessary security of attachment.

A cap having a plurality of threads but running at a steep angle may display a tendency to rotate slightly backward from its totally closed position. The steep angle of the threads will cause the cap to move substantially from the top of the bottle. Accordingly, placing serrations along at least a portion of the length of the threads on the cap can help prevent the rotation of the cap in the reverse direction.

The serrations on the threads prove useful even in the case of the milk or juice bottles in which the caps have ratchet rings matching ratchet teeth on the bottle. Typically, the ratchet ring includes approximately 20 teeth in the circle. This allows the cap to move up to 18 degrees without the teeth in the cap's ratchet ring moving from one tooth to another in the matching ratchet on the bottles. This rotation could still possibly permit the cap to slightly disengage from the top of the bottle. The serrations on the threads of the cap minimize this likelihood of rotation.

Especially do the serrations on the threads of the cap prove effective where the threads on the neck of the bottle also display serrations. In this instance, the bottle, aside from having a body for holding a substance and an opening of the body, includes a cylindrical neck coupled in a fluid tight connection to its opening. Naturally, the neck has a size to fit snugly inside of the cap.

The outside neck of the bottle includes the same number of screw threads as appears on the inside of the cap. The serrations then appear on the threads of the neck of the bottle to engage the serrations on the threads of the cap. The mutual engagement of serrations provides strong assurance that the bottle cap will not inadvertently rotate or disengage.

The cap with screw threads on its interior cylindrical surface and a ring of ratchet teeth must, in an automated fashion, become attached to the neck of the milk or juice bottle. A difficulty encountered in this procedure involves the possibility of the cap's ratchet ring engaging the bottle's ratchet teeth. This could prevent the cap from rotating in the fashion needed to screw onto the bottle.

An applicator for applying a bottle cap to the bottle may include first a retaining device having first and second configurations. In the first of the configurations, it would hold a particular bottle cap at a particular location. In the second of its configurations, the retaining device would allow the movement of the bottle cap in the direction that the bottles move on the conveyor.

A tension device then couples to the retaining device to control its actions. Acting under the force of gravity, the tension device urges the retaining device into the first configuration in which it holds the bottle caps at the desired location. The tension device, however, is overcome and the retaining device can move to the second configuration through the force of the bottle acting in contact with the particular cap. The bottle's moving in the indicated direction on the conveyor provides the required force to overcome the tension device.

Acting under the force of gravity, the tension device does not require springs or other complicated mechanisms. Thus, it displays less propensity of breaking down or becoming ineffective.

As an alternate aspect, the retaining device can hold one of the bottle caps at the particular location with the cap's open end at a predetermined angle relative to the tops of the necks of the bottles moving on the conveyor. In particular the retaining device should hold a particular cap with its ratchet ring remaining entirely above the ratchet ring or teeth on the bottle upon which the cap will be placed. It must do so at least while the applicator rotates the cap. This avoids the two sets of teeth from engaging each other and preventing the rotation of the cap necessary to place it securely on the bottle.

However, the retaining device holds the cap at a sufficiently low height that the ratchet ring at least falls below at least a portion of the top of the bottle's neck. This allows the neck of the bottle to make contact with the cap and pull it along to a location where the applicator will seat the cap upon the bottle.

BRIEF DESCRIPTION OF THE FIGURES

FIG. 1 gives a bottom plan view of a bottle cap having four lead threads and serrations on the threads themselves.

FIG. 2 gives a cross-sectional view along the line 2—2 of the bottle cap of FIG. 1.

FIG. 2*a* gives an enlarged view of the serrations on the threads of the bottle cap of FIGS. 1 and 2.

FIG. 3 provides a top plan view of the neck of a bottle upon which the cap of FIGS. 1 and 2 will sit.

FIG. 4 gives a side elevational view of the bottle neck of FIG. 3.

FIG. 4*a* gives an enlarged view of the serrated thread of FIG. 4.

FIG. 5 displays a side cross-sectional view of the bottle cap of with FIGS. 1 and 2 sitting on the bottle neck of FIGS. 3 and 4.

FIG. 6 gives a top, left isometric view of an applicator for applying bottle caps to bottles moving on a conveyor.

FIG. 7 shows a bottom left isometric view of the applicator of FIG. 6.

FIG. 8 provides a side elevational view of the applicator of FIGS. 6 and 7 applying caps to a bottle.

FIG. 9 gives a bottom plan view of the applicator of FIG. 8.

FIG. 10 depicts a front elevational view of the applicator seen in FIG. 8.

DETAILED DESCRIPTION

Figure 11:
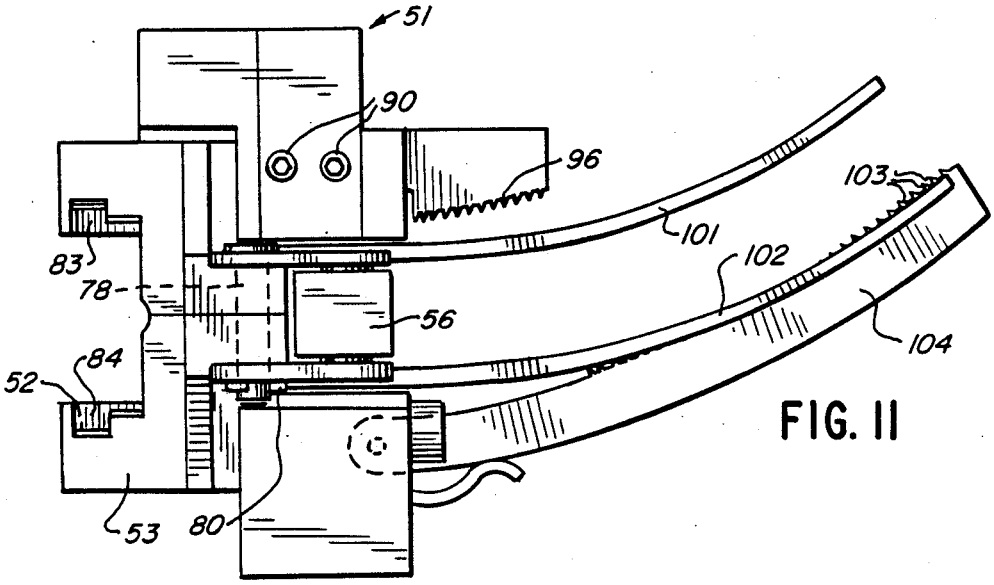
FIG. 11 depicts a top plan view of the bottle cap applicator of FIGS. 6 to 10 which, as viewed from the top, applies caps to bottles turning to the left.

The bottle cap shown generally at 21 in FIGS. 1 and 2 includes the cylindrical side 22 and the top 23 at the closed end. The ring 24 of ratchet teeth 25 attaches to the open end of the cap 21.

The ratchet ring 24, of course, keeps the cap 21 securely affixed to a bottle. It does not permit its removal without its separation from the cap 21. To permit this separation, the ratchet ring 24 includes the tab 26 having the thin bridge 27 to the remainder of the ring. Breaking the bridge 27 exposes the tab 26. The consumer may then pull on the tab 26 and remove the ratchet ring 24 from the cap 21 to open the bottle.

The cap 21, on the inside of the cylindrical wall 22, includes the four screw threads 31. The threads 31, naturally, permit the attachment of the cap 21 to a bottle.

Near their tops, each of the screw threads 31 includes the serrations 32. This appears more clearly in FIG. 2*a*. The serrations 32 help prevent the inadvertent rotation of the cap in the direction which could provide a slight opening to the bottle. The serrations 32 have particular effectiveness where the matching screw threads on the bottle itself also include serrations which can engage these on the cap.

Incorporating the four screw threads 31 into the cap 21 results in each of the threads 31 having a greater helical angle than if the cap 21 had fewer threads. In particular, each thread travels around the cap twice per inch of cap along the axis of symmetry of the cylindrical side 22. Further, to accommodate the increased helical angle, each of the threads has a 60 degree included angle and a 0.015 inch flat at the apex of the angle.

Lastly, the cap 21 includes the annular ridge 35 molded into its top 23. As discussed below, this provides stiffening to the lip of the bottle mouth.

FIGS. 3, 4, and 4*a* show generally at 41 a bottle upon which the cap 21 may sit. In particular, the bottle 41 includes the body 42 which has the opening 43. The cylindrical neck 44 attaches to the bottle body 42 at the opening 43. The neck 44 includes the four screw threads 45 which, of course, engage the threads 31 in the cap 21.

Each of the threads 45 includes the serrations 46 near their tops, as seen more clearly in FIG. 4*a*. The serrations 46 on the bottle neck 44 engage the serrations 32 on the cap 21 to assure the cap 21 will not accidentally rotate and become even partially disengaged from the bottle neck 44.

The bottle 41 also includes the ratchet teeth 47 that sit at the bottom of its neck 44. The teeth 44 engage the cap's ratchet ring of teeth 25 when the cap 21 screws firmly upon the bottle 41.

Further, the top of the bottle neck 44 has the slight lip 48 to provide it with increased rigidity. As seen in FIG. 5, the lip 48, when the cap 21 engages with the bottle 41, sits in the well 49 between the ridge 35 and the sidewall 22 of the cap 21. This helps prevent any substantial bending of the neck 44.

The applicator shown generally at 51 in FIGS. 6 to 10 serves to firmly seat the caps 21 upon the bottles 41 as the latter move along a conveyor line. Initially, the caps 21 enter the slot 52, formed in the fixed frame 53 and seen most clearly in FIGS. 7 to 9, from some suitable feed chute.

The caps slide down the slot 52 until they make contact with the ridges 55 of the floating frame 56. As seen in FIG. 8, the caps may sit in the chute 52 at an angle of about 20 degrees relative to the horizon and, in particular, relative to the direction that the bottles 41 move on the conveyor.

The floating frame 56, which as seen in the figures, consists primarily of a large metal block, coupled to the fixed frame 53 through the four links 61 to 64. The dowel 65 passes through the link 61, the floating frame 56, and then the link 62, as seen in FIG. 10 and permits relative motion of these components. The head 66 of the dowel 65 on one side and the cotter pin 67 at the opposite end of the dowel 65 keep all of these components in place.

Similarly, the dowel 68 passes through the links 61 and 62 and the fixed frame 53. Its head 69 and the cotter pin 70 permit rotational motion between the components. Thus, the links 61 and 62 with the dowels 65 and 68 serve to couple the bottom portions of the floating frame 66 and the fixed frame 63 together. However, the coupling does permit relative motion between the two frames in a slightly arcwise manner, which remains primarily vertical as seen from the phantom outline in FIG. 8.

In a very similar fashion, the dowel 73 with its head 74 and cotter pin 75 rotatably couple the upper links 63 and 64 to the floating frame 56. Also, the dowel 78 with its head 79 and cotter pin 80 retain the same links to the fixed frame 53.

The weight of the sliding frame 56, because of the force of gravity, causes it to move in the downward direction where it retains the bottle cap 21 in place. However, as the bottle 41 moves along the conveyor and makes contact with the cap, it has sufficient force to push the cap 21 against the ridges 55 of the fixed frame 56 to overcome the weight of the latter and force it in an upward direction. This allows the cap to move horizontally to the right as seen in FIGS. 7 to 9.

As the cap moves to the right, the ridges 83 and 84 of the chute 52 keep it elevated so that the ratchet ring 24 of the cap cannot engage the ratchet teeth 47 of the bottle 41. This allows the rotation of the cap, described immediately below, to proceed without interference from the accidental engagement of the two sets of ratchet teeth.

Immediately as the cap begins to move along the slot 52 under the action of the bottle 41, it makes contact with the ridge 87 which sits in front of the first segment of teeth 88. Moreover, depending upon the exact positioning of the cap 21 within the slot 52, the cap may make contact with the ridge 87 prior to the ridges 55. Thus, the ridge 87 helps assure the placement of the cap so that it may properly contact the bottle 41.

Accordingly, in order to undergo any transitional movement, the cap will push against the ridge 87 which forms part of the plate 89 as generally do also the teeth 88. The screws 90 in turn attach the plate 89 to the weight 91 which couples to and may pivot about the extension 93 of the main frame 53.

The screw 94 provides for a pivotal connection between the weight 91 and the main frame extension 93. Again, the weight 91 acting under the force of gravity urges the ridge 87 and subsequently the teeth 88 against the cap 21. The motion of the bottle 41 on the conveyor overcomes the force of gravity acting on this component to allow the cap 21 to move past its original resting place in the applicator 51.

As appears in FIGS. 8 and 10, the cap 21 includes the serrations 95 on its outer surface. As the cap continues to move to the right until it reaches the first position on FIG. 9, the teeth 88 bear against and engage the serrations 95. This causes the cap to rotate in a counterclockwise direction from the top of the bottle 41. This direction runs contrary to that needed actually to screw the bottle cap onto the bottle. The reverse direction assures the proper seating of the cap upon the bottle prior to twisting it in the direction needed to engage it with the bottle.

As the cap continues to move to the right, it disengages from the first portion of teeth 88 and moves to the second portion of teeth 96 also on the plate 89. As seen in FIG. 9, the teeth 96 do not fall into a straight line with the teeth 88. The curvature of the direction of the teeth 96 from that of the teeth 88, with both on the same plate 89, permits the curvature of the path followed by the cap 21 so it may follow a curved conveyor line.

As the teeth 96 engage the serrations 95 of the cap 21, it continues the counterclockwise rotation of the cap to make sure it properly sets on the bottle 41. In combination, the teeth 88 and 96 effectuate a quarter revolution turn of the cap 21 in the counterclockwise direction.

As the cap moves towards the end and out of the chute 52, its upper surface makes contact with the runners 101 and 102. The runners 101 and 102 have a welded connection to the floating frame 56. As a consequence, the weight of the floating frame 56 urges the runners 101 and 102 onto the tops of the caps 21 to keep them in contact and properly seated upon the bottles 41.

As the caps continue the motion past the teeth 96, their serrations 95 will engage the teeth 103 attached to the bar 104. The bar 104, in turn, possesses a journaled connection at the pin 105 to the main frame 53. However the arm 106 bears against the bar 104 urging it into contact against the bottle caps 21.

The arm 106 in turn attaches to the weight 107 which, in turn, the bolt 108 pivotally connects to the fixed frame 53. The cap moving in contact with the bar 104 pushes it outward which forces the arm 106 to the left as seen in FIG. 10. In turn, the weight 107 pushes the arm 106 back against the bar 104 to make sure that the teeth 103 engage the serrations 95 on the cap 21. The position of the weight 107 when urging the bar 104 against the bottle cap appears in phantom in FIG. 10. Furthermore, bending the arm 106 allows the adjustment of the location of the bar 104 and thus the teeth 103 as it contacts and bears against the bottle caps 21.

Thus, the bar 104, acting under the influence of the weight 107 passed through the arm 106, urges the teeth 103 against the serrations 95 of the cap 21. This causes the cap to rotate in a clockwise direction as viewed from above. This serves to twist the cap onto the bottle for the preapplication of the cap. In this preapplication process, the cap 21 twists upon the bottle 41 until the ratchet ring 24 in the former starts to engage the ratchet teeth 47 on the ladder. This involves approximately one quarter of a complete revolution effectuated by the teeth 103.

The bottle with the cap preapplied then moves to a capping station. At this point, the cap receives sufficient torque to form a firm and complete closure of the bottle 41.

In FIGS. 6 and 10, the openings 111 permit the attachment of the applicator 51 to an assembly line already in operation. As seen in the figures, the applicator 51 requires very little room on the conveyor.

Figure 12:
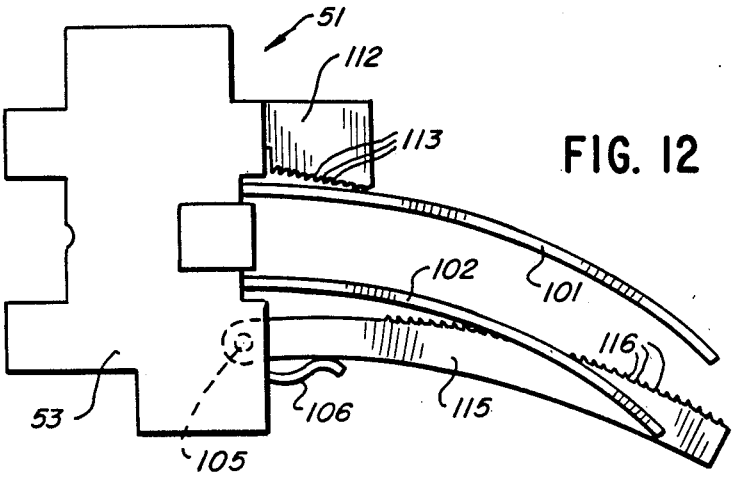
FIG. 12 shows a top plan view of the same applicator of FIG. 11 but with different teeth to follow bottles moving on a conveyor turning to the right.

As shown in FIGS. 6 to 11, the applicator 51 displays a configuration that will allow it to place caps upon bottles on a conveyor undergoing a turn to the left. Should the conveyor turn the bottles in the opposite direction, the applicator 51 will take the configuration shown in FIG. 12. This involves, first, merely bending the runners 101 and 102 to the opposite direction to that shown in FIG. 11. Additionally, a changed direction of movement will require replacing the plate 89 with its teeth 96. Accordingly, the plate 112 with the teeth 113 can follow the bottle cap as it moves towards the right. Additionally, the bar 104 would have the wrong curvature for the configurations shown in FIG. 12. Accordingly, the bar 115 with the teeth 116 would provide the desired continuous engagement with the cap as the bottle turns towards the right.

Figure 13:
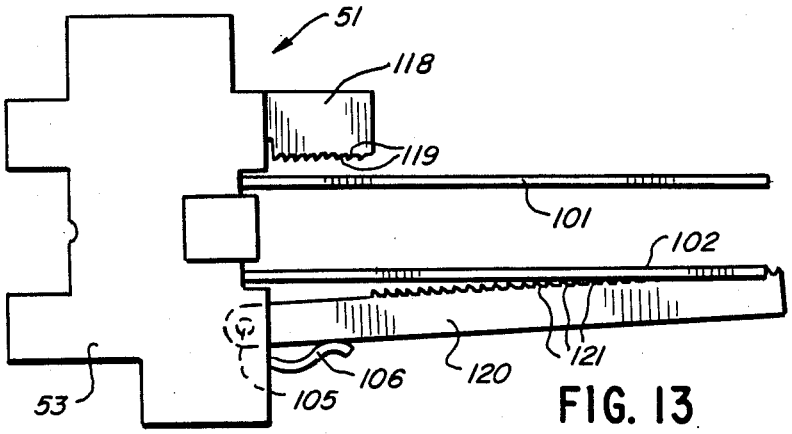
FIG. 13 shows the applicator of the prior figures but for placing caps on bottles moving in a straight line on a conveyor.

In the unusual circumstance of the conveyor moving the bottle in a straight direction, the configuration shown in FIG. 13 would serve to apply the caps in the usual fashion. In this instance, the plate 118 with the teeth 119 and the bar 120 with the teeth 121 will follow the cap as it moves on the bottle in a straight direction.

Accordingly, what is claimed is:

1. An applicator for applying a bottle cap having a first plurality of screw threads to a bottle moving in a predetermined direction on a conveyer having a neck with a second plurality of matching screw threads comprising:

(A) a chute with substantially smooth surfaces for said caps;

(B) retaining means having first and second configurations for, in the first of said configurations, holding a particular one of said caps at a particular location in said chute and, when in said second configuration, allowing the movement of said particular cap in said particular direction; and (C) tension means including a weight, coupled to said retaining means and acting under the force of gravity, said weight being sufficient to urge said retaining means into said first configuration, said tension means being overcome and said retaining means being moved to said second configuration by the force of a bottle in contact with said particular cap and moving in said particular direction on said conveyer.

2. The applicator of claim 1 further including restricting means, coupled to said retaining means, for, when said retaining means is in said second configuration, containing said cap at a sufficient elevation as said bottle moves said cap in said particular direction that substantially all of said first ratchet ring remains entirely above said second ratchet ring.

3. The applicator of claim 1 further including:

(1) first rotating means, coupled to said retaining means, for, as said bottle moves said cap in said particular direction, rotating said cap in a first direction; and (2) second rotating means, coupled to said first rotating means, for, as said bottle moves said cap in said particular direction and after said first rotating means has rotated said cap in said first direction, rotating said cap in a second direction opposite to said first direction.

4. The applicator of claim 3 wherein said retaining means holds said particular one of said caps at an angle of about 20 degrees relative to the horizontal and to said particular direction.

5. The applicator of claim 4 wherein said tension means operates without the application of any substantial force other than the force of gravity.

6. The applicator of claim 3 wherein said first rotating means includes:

(1) a row of teeth, said row being aligned in said particular direction and said teeth pointing towards said cap in a third direction substantially perpendicular to said particular direction; and (2.) pressing means, acting under the force of gravity, urging said row of teeth toward said bottle cap.

7. The applicator of claim 6 wherein said row is a first row and said pressing means is a first pressing means and wherein said second rotating means includes:

(1) a second row of teeth, said second row being aligned aligned in a fourth direction substantially opposite to said third direction with said teeth pointing toward said cap in said fourth direction; and (2) second pressing means urging said second row of teeth toward said bottle cap in said fourth direction and acting under the force of gravity.

8. The applicator of claim 7 including first and second coupling means for releasably holding said first and second rows of teeth, respectively, to said retaining means.

9. The applicator of claim 8 further including running means, coupled to said retaining means, for preventing removal of the cap from said particular bottle while said first or said second rows of teeth are in contact with said cap and wherein the shape of said running means may be changed to follow a change in said particular direction.

10. The applicator of claim 1 wherein said tension means acts substantially only under the force of gravity acting on said weight.

11. The applicator of claim 1 further including guiding means, coupled to said retaining means, for limiting the motion of said retaining means to a predetermined path as it moves between said first and second configurations, said path, as said retaining means moves into said first configuration, having a component of direction substantially opposed to said particular direction.

12. An applicator for applying bottle caps having a first plurality of screw threads and a first ratchet ring at its open end to bottles, moving in a predetermined direction on a conveyer, having a neck with a second plurality of matching screw threads and a second ratchet ring at its bottom comprising:

(A) a chute with substantially smooth surfaces for said caps;

(B) retaining means having first and second configurations for, in the first of said configurations, holding a particular one of said caps at a particular location in said chute with said open end at a predetermined angle relative to the tops of said necks of said bottles moving on said conveyer, said retaining means holding said one particular cap with said first ratchet ring entirely above said second ratchet ring but at least in part below the top of said neck, and when in said second configuration, allowing the movement of said particular cap in said particular direction; and (C) tension means including a weight, coupled to said retaining means and acting under the force of gravity, said weight being sufficient to urge said retaining means into said first configuration, said tension means being overcome and said retaining means being moved to said second configuration by the force of a bottle in contact with said particular cap and moving in said particular direction on said conveyer.

13. The applicator of claim 12 further including:

(1) first rotating means, coupled to said retaining means, for, as said bottle moves said cap in said particular direction, rotating said cap in a first direction; and (2) second rotating means, coupled to said first rotating means, for, as said bottle moves said cap in said particular direction and after said first rotating means has rotated said cap in said first direction, rotating said cap in a second direction opposite to said first direction.

14. The applicator of claim 13 wherein said first rotating means includes:

(1) a row of teeth, said row being aligned in said particular direction and said teeth pointing towards said cap in a third direction substantially perpendicular to said particular direction; and (2) pressing means, acting under the force of gravity, urging said row of teeth toward said bottle cap.

15. The applicator of claim 14 wherein said row is a first row and said pressing means is a first pressing means and wherein said second rotating means includes:

(1) a second row of teeth, said second row being aligned in a fourth direction substantially opposite to said third direction with said teeth pointing toward said cap in said fourth direction; and (2) second pressing means urging said second row of teeth toward said bottle cap in said fourth direction and acting under the force of gravity.

16. The applicator of claim 15 including first and second coupling means for releasably holding said first and second rows of teeth, respectively, to said retaining means.

17. The applicator of claim 12 wherein said tension means acts substantially only under the force of gravity action on said weight.

18. The applicator of claim 12 further including guiding means, coupled to said retaining means, for limiting the motion of said retaining means to a predetermined path as it moves between said first and second configurations, said path, as said retaining means moves into said first configuration, having a component of direction substantially opposed to said particular direction.

19. An applicator for applying a bottle cap having a first plurality of screw threads to a bottle moving in a predetermined direction on a conveyer having a neck with a second plurality of matching screw threads comprising:

(A) retaining means having first and second configurations for, in the first of said configurations, holding a particular one of said caps at a particular location and, when in said second configuration, allowing the movement of said particular cap in said particular direction;

(B) tension means, coupled to said retaining means and acting under the force of gravity, to urge said retaining means into said first configuration, said tension means being overcome and said retaining means being moved to said second configuration by the force of a bottle in contact with said particular cap and moving in said particular direction on said conveyer; and (C) rotating means, coupled to said retaining means, for, as said bottle moves said cap in said particular direction, rotating said cap in a first direction, said rotating means including (1) a row of teeth, said row being aligned in said particular direction and said teeth pointing towards said cap in a second direction substantially perpendicular to said particular direction and (2) pressing means, acting under the force of gravity, urging said row of teeth toward said bottle cap.

20. The applicator of claim 19 wherein said rotating means is a first rotating means, said row is a first row, and said pressing means is a first pressing means and further including second rotating means, coupled to said first rotating means, for, as said bottle moves said cap in said particular direction and after said first rotating means has rotated said cap in said first direction, rotating said cap in a third direction opposite to said first direction, said second rotating means including a second row of teeth, said second row being aligned in a fourth direction substantially opposite to said third direction with said teeth pointing toward said cap in said fourth direction, and second pressing means urging said second row of teeth toward said bottle cap in said fourth direction and acting under the force of gravity.

21. The applicator of claim 20 wherein said cap has a ratchet ring at its open end and said bottle has a set of ratchet teeth at the bottom of its neck and further including restricting means, coupled to said retaining means, for, when said retaining means is in said second configuration, holding said cap at a sufficient elevation as said bottle moves said cap in said particular direction that substantially all of said ratchet ring remains entirely above said set of ratchet teeth.

22. The applicator of claim 21 wherein said retaining means holds said particular one of said caps at an angle of about 20 degrees relative to the horizontal and to said particular direction.

23. The applicator of claim 22 wherein said tension means operates without the application of any substantial force other than the force of gravity.

24. The applicator of claim 23 including first and second coupling means for releasably holding said first and second rows of teeth, respectively, to said retaining means.

25. The applicator of claim 24 further including running means, coupled to said retaining means, for preventing removal of the cap from said particular bottle while said first or said second rows of teeth are in contact with said cap and wherein the shape of said running means may be changed to follow a change in said particular direction.

* * * * *